US007670387B2

(12) United States Patent
Chen

(10) Patent No.: US 7,670,387 B2
(45) Date of Patent: Mar. 2, 2010

(54) PROCESS FOR PRODUCING SYNTHETIC FIBER FABRIC HAVING TRANSLUCENT PRINTING (DYEING) PATTERNS AND FABRIC THUS OBTAINED

(75) Inventor: Young-Chin Chen, Touliu (TW)

(73) Assignee: Formosa Taffeta Co., Ltd. (TW)

( * ) Notice: Subject to any disclaimer, the term of this patent is extended or adjusted under 35 U.S.C. 154(b) by 341 days.

(21) Appl. No.: 10/767,051

(22) Filed: Jan. 29, 2004

(65) Prior Publication Data

US 2004/0182821 A1 Sep. 23, 2004

(30) Foreign Application Priority Data

Jan. 30, 2003 (TW) ..... 92102230 A

(51) Int. Cl.
*D06Q 1/02* (2006.01)

(52) U.S. Cl. ..... 8/114.6; 8/448; 8/458; 8/478; 8/115.65; 8/115

(58) Field of Classification Search ..... 216/54; 427/256, 504; 428/515, 90; 8/114.6, 458, 8/448, 478, 115.65, 115
See application file for complete search history.

(56) References Cited

U.S. PATENT DOCUMENTS 3,787,212 A * 1/1974 Heimsch et al. ..... 430/286.1
4,252,891 A * 2/1981 Kostyshin et al. ..... 430/323
4,255,231 A * 3/1981 Boba et al. ..... 216/83
4,292,392 A * 9/1981 Ikeda et al. ..... 430/271.1
4,415,331 A * 11/1983 Dusenbury et al. ..... 8/114.6
4,424,240 A * 1/1984 Kielbania, Jr. ..... 427/393.5
4,507,342 A * 3/1985 Kielbania, Jr. ..... 428/90
4,555,414 A * 11/1985 Hoover et al. ..... 427/504
4,826,605 A * 5/1989 Doble et al. ..... 210/721
6,376,041 B1 * 4/2002 Morrison et al. ..... 428/89
6,932,451 B2 * 8/2005 Annacone ..... 347/2

FOREIGN PATENT DOCUMENTS

| | | |
|---|---|---|
| CN | 1 252 846 | 6/2003 |
| DE | 1140544 | * 12/1962 |
| JP | 63-125934 | * 5/1998 |
| TW | 413706 | 12/2000 |
| TW | 430701 | 4/2001 |
| WO | 98/46820 | 10/1998 |

OTHER PUBLICATIONS

English abstract of TW 430701 dated Apr. 21, 2001.
English abstract of TW 413706 dated Dec. 1, 2000.

* cited by examiner

*Primary Examiner*—Lorna M Douyon
*Assistant Examiner*—Amina Khan
(74) *Attorney, Agent, or Firm*—Ladas & Parry LLC

(57) ABSTRACT

The invention relates to a synthetic fiber fabric having translucent printing (dyeing) patterns thereon. The invention also relates to a process for producing a synthetic fiber fabric having translucent printing (dyeing) patterns thereon, which includes a printing step prior to an etching step, wherein the printing step includes printing a paste for dyeing and/or printing containing a transparent printing developer onto a surface of the fabric.

14 Claims, No Drawings

PROCESS FOR PRODUCING SYNTHETIC FIBER FABRIC HAVING TRANSLUCENT PRINTING (DYEING) PATTERNS AND FABRIC THUS OBTAINED

FIELD OF THE INVENTION

The subject invention relates to a synthetic fiber fabric having translucent printing (dyeing) patterns thereon. The subject invention also relates to a process for producing the synthetic fiber fabric having translucent printing (dyeing) patterns thereon.

BACKGROUND OF THE INVENTION

In prior art, the technique of etching a printing pattern is only applied to natural cellulose fiber products, wherein the cellulose fiber is etched by an acid to form patterns thereon. There is no commercially available synthetic fiber fabric having translucent printing (dyeing) patterns thereon. Generally, the use of the conventional printing (dyeing) process in a synthetic fiber fabric is merely to print patterns thereon. The conventional printing (dyeing) process mainly comprises the steps of presetting, etching (reducing the cellulose fiber), dyeing, printing, drying, fixing, soaping, and final treatment. The etching step is directed to render the fiber surfaces uneven by using an etching agent so as to improve the properties of the fiber such as feel. However, the conventional processes cannot provide a synthetic fiber fabric having translucent printing (dyeing) patterns thereon.

Accordingly, a process for producing a synthetic fiber fabric having translucent printing (dyeing) patterns thereon is highly desired.

SUMMARY OF THE INVENTION

The present invention relates to a process for producing a synthetic fiber fabric having translucent printing (dyeing) patterns thereon.

The present invention also relates to a synthetic fiber fabric having translucent printing (dyeing) patterns thereon.

DETAILED DESCRIPTION OF THE INVENTION

By way of illustration and to provide a more complete appreciation of the present invention with many of the attendant advantages thereof, the following detailed description is given concerning a process for producing a synthetic fiber fabric having translucent printing (dyeing) patterns thereon and a synthetic fiber fabric having translucent printing (dyeing) patterns thereon.

The present invention relates to a process for producing a synthetic fiber fabric having translucent printing (dyeing) patterns thereon. The process comprises a printing step conducted prior to an etching step and the printing step comprises printing a paste for dyeing and/or printing comprising a transparent printing developer onto a surface of the fabric. Specifically, the process comprises the steps of presetting, printing, drying, fixing, etching, soaping, dyeing and final treatment. Optionally, the order of the steps can be adjusted or additional steps can be applied therebetween if the adjustment of order or the additional steps would not result in a negative influence on the desired translucent effect of the patterns. For example, a sanding step can be applied between the presetting step and printing step, the dyeing step can be replaced by a dyeing & printing step. Furthermore, the dyeing step can be conducted prior to the dyeing & printing step or the dyeing & printing step can be conducted prior to the dyeing step.

In the printing step, a transparent printing developer is mixed with a paste for dyeing and/or printing in suitable amounts and the mixture is printed onto a surface of a fabric to form printing patterns thereon. In the etching step, the transparent printing developer accelerates the etching homogeneously. Hence, the fabric surface containing the transparent printing developer has a special etching effect and a difference in transparence from those of fabric surfaces that do not contain the transparent printing developer. Hence, patterns having special translucent effects are formed on the fabric.

The steps of the process of the invention are described as follows.

Presetting

A griege is scoured and delivered to a presetting machine to preset the griege to form a fabric. The speed of the presetting machine can be, for example, from 15 to 120 meter/min. The temperature of the presetting machine can be, for example, 100 to 210° C.

Printing, Drying, Fixing

The fabric is treated in a printing machine, for example, a roller-printing machine or an automatic screen-printing machine. A transparent printing developer is mixed with a paste for dyeing and/or printing in suitable amounts (for example, the amount of, the transparent printing developer is 1 to 50 weight percent, preferably 3 to 15 weight percent, based on the total of the transparent printing developer and paste) to form a paste mixture. The paste mixture is printed onto the surface of the fabric at a speed of 5 to 150 meter/min to form a printing pattern on the fabric. The fabric is dried at a temperature from 50° C. to 210° C. and fixed at a temperature from 100° C. to 210° C. to render the printing pattern containing the transparent printing developer and paste bonded to the fabric surface.

The transparent printing developer suitable for the invention includes a quaternary ammonium salt ion promoter. Persons skilled in the art can select a suitable quaternary ammonium salt as a promoter for the etching agent, for example, tetraalkyl ammonium iodide ($NR_4I$) and tetraalkyl ammonium hydroxide ($NR_4OH$). Generally, a quaternary ammonium salt is used as a promoter in the etching step involved in conventional dyeing and finishing processes to accelerate etching. However, conventional dyeing and finishing process does not produce a printing (dyeing) fabric having translucent patterns thereon. In other words, a quaternary ammonium salt is merely used in the conventional dyeing and finishing process to promote the etching, but not to produce a printing (dyeing) fabric having translucent patterns thereon.

Etching

The synthetic fiber fabric having the transparent printing developer-containing paste is treated by a suitable etching agent in a suitable concentration (for example, 1 to 50 Be, preferably 15 to 35 Be) under suitable conditions, for example at a speed of 5 to 120 meter/min and at a temperature of 20° C. to 150° C. The synthetic fiber fabric thus treated has a translucent printing (dyeing) pattern on the surface of the fiber to obtain a special translucent effect.

Persons skilled in the art can select suitable etching agents to effect etching. The etching agents include, but are not limited to, sodium hydroxide, sodium carbonate and sodium hydrogen carbonate.

Soaping

The synthetic fiber fabric is then subjected to a soaping step, for example at a speed of 1200 yards/piece, to remove the impurities and processing agents on the fabric. The soaping conditions include, but are not limited to, a soaping temperature of 4° C. to 120° C. and a speed of 20 to 120 meter/min.

Dyeing

The synthetic fiber fabric is dyed with suitable dyes, for example, acid dyes, disperse dyes, cationic dyes, reactive dyes, indanthrene dyes (vat) and direct dyes, together with suitable dying auxiliaries in, for example, an air flow dyeing machine, a jigger dyeing machine, a winch dyeing machine, a beam dyeing machine, a jet dying machine, a rapid dyeing machine or a continuous dipping & padding dyeing machine under, for example, a temperature of 40° C. to 170° C.

The synthetic fiber fabric, which is dyed or not dyed, is subjected to a dyeing & printing step. The synthetic fiber fabric is treated by suitable dyes, pigments, gold powder, silver powder, and a printing paste in a roller printing machine or automatic screen printing machine to conduct dyeing & printing under conditions, for example a speed of 15±5 meter/min. Suitable dyes include, for example, acid dyes, disperse dyes, cationic dyes, reactive dyes, indanthrene dyes (vat) or direct dyes. Alternatively, the dyeing & printing can be replaced by a transfer printing.

Either the dyeing step or dyeing & printing step, or both, can be used as desired to practice the invention. In the latter case, the dyeing step and the dyeing & printing step can be subsequently used in any order.

Final Treatment

The synthetic fiber fabric can be optionally subjected to a final treatment, for example softening, water-repelling, cold-hot calender, coating, lamination, and special waterproofing. For example, the synthetic fiber fabric can be delivered to a tank containing a softening agent to conduct the softening treatment or to a tank containing a water-repellent agent to conduct the water-repelling treatment. Then, the synthetic fiber fabric is delivered to a machine at a suitable speed (for example 35 to 55 meter/min), a suitable height (60 to 100 mm, for example 80 mm), a suitable angle (0.75 to 1.05 mm, for example, 0.95 mm), a suitable temperature (110° C. to 130° C., for example 120° C.) to conduct the waterproofing treatment. The synthetic fiber fabric is then stored for a suitable period of time to effect crosslinking. The fabric can be optionally subjected to a final setting to obtain the final product.

The following example is provided to further explain the invention from which the artisans can further appreciate the invention. However, the example should not be considered as a limitation to the scope of the invention.

EXAMPLE

A griege of 450±50 yards/piece is subjected to a scouring treatment wherein the temperature of the scouring liquid is about 90±5° C. and the speed is 50±10 meter/min. After scouring treatment, the griege is delivered to a presetting machine to form a fabric at a speed of 80±5 meter/min and at a temperature of 200±5° C. A printing paste containing a transparent printing developer, tetraalkyl ammonium hydroxide ($NR_4OH$), in which the amount of the transparent printing developer is 3 to 15 weight percent, based on the total of the transparent printing developer and paste, is printed on the fabric in a roller printing machine or automatic screen printing machine at a speed of 15±5 meter/min to form a desired printing pattern on the fabric. The fabric is then dried at a temperature of 110±10° C. and fixed at a temperature of 160±20° C. The fabric is further subjected to an etching treatment in a tank having an etching agent (sodium hydroxide) with a concentration of 15 to 35 Be at a speed of 30±10 meter/min and at a temperature of 100° C.±15° C. to form a printing fabric having a translucent pattern thereon. The fabric is soaped at 450±50 yards/piece at a temperature of 100° C.±20° C. and at a speed of 50±10 meter/min. The fabric is then dyed at a temperature of 100° C.±30° C. with a dye including a dyeing auxiliary. The fabric is delivered to a tank containing a water-repellant agent to conduct a water-repelling treatment. The fabric is then delivered to a waterproofing machine at a speed of 45±5 meter/min, with a height of 80 mm, a angle of 0.95 mm, a temperature of 120° C. to conduct a waterproofing treatment. Then, the fabric is stored for a period of 16 hours to effect crosslinking. The fabric is subjected to a final setting conducted under a temperature of 130° C., a width of 66 inches, and a speed of 60±10 meter/min to obtain a final product.

The present invention may, of course, be carried out in other specific ways than those herein set forth without departing from the spirit and essential characteristics of the present invention. The present embodiments are, therefore, to be considered in all respects as an illustration and are not restrictive.

What is claimed is:

1. A process for producing a synthetic fiber fabric having a translucent pattern thereon, comprising printing a paste which, after etching, results in translucency of the fabric, onto a surface of the synthetic fiber fabric to form a printed fabric with a printed pattern thereon, wherein the paste comprises a transparent printing developer, and the transparent printing developer is a quarternary ammonium salt;

and, after formation of the printed pattern, treating the printed fabric with an etching agent the transparent printing developer accelerating etching of the fabric homogeneously, so as to form the fabric having the translucent pattern thereon.

2. A process according to claim 1, wherein the etching agent is sodium hydroxide, sodium hydrogen carbonate or sodium carbonate.

3. A process according to claim 1, wherein the paste consists essentially of the transparent printing developer.

4. A process for producing a translucent pattern on a synthetic fiber fabric, comprising the steps of:

(a) printing a paste which, after etching, results in translucency of the fabric, onto a surface of the synthetic fiber fabric to form a printed pattern thereon, wherein the paste comprises a transparent printing developer, and the transparent printing developer is a quarternary ammonium salt;

(b) treating the printed fabric of step (a) to bond the paste comprising the transparent printing developer to the surface of the synthetic fiber fabric; and (c) treating the printed fabric with an etching agent;

whereby the transparent printing developer accelerates the etching agent thereby forming the printed pattern into the translucent pattern on the synthetic fiber fabric.

5. A process according to claim 4, wherein the etching agent is sodium hydroxide, sodium hydrogen carbonate or sodium carbonate.

6. A process according to claim 4, wherein the transparent printing developer is 1 to 50 weight percent of the paste.

7. A process according to claim 6, wherein the transparent printing developer is 3 to 15 weight percent of the paste.

8. A process according to claim 4 further comprising the step of drying the printed fabric after the printing step (a).

9. A process according to claim 4, wherein the treating step (b) comprises the step of drying the fabric at a temperature from 50° C. to 210° C.

10. A process according to claim 4, wherein the treating step (b) comprises the step of fixing the fabric at a temperature from 100° C. to 210° C.

11. A process according to claim 4, wherein the paste consists essentially of the transparent printing developer.

12. A process for producing a translucent pattern on a fabric comprising synthetic fibers, the process comprising printing a paste which, after etching, results in translucency of the fabric, onto select surfaces of the fabric to form a printed fabric with a printed pattern, wherein the paste comprises a transparent printing developer, and the transparent printing developer is a quarternary ammonium salt;

and, after formation of the printed pattern, etching the printed fabric in a tank comprising an etching agent, the transparent printing developer accelerating etching of the fabric homogeneously, to provide a difference in transparence between the select surfaces and other surfaces of the fabric that do not contain the printing developer thereby to form the translucent pattern on the fabric.

13. The process according to claim 12, wherein the etching agent is sodium hydroxide, sodium hydrogen carbonate or sodium carbonate.

14. A process according to claim 12, wherein the paste consists essentially of the transparent printing developer.

* * * * *